United States Patent [19]

Wilmoth et al.

[11] Patent Number: 4,858,873

[45] Date of Patent: Aug. 22, 1989

[54] NON-STICK DRINK COASTER

[76] Inventors: Charles C. Wilmoth; Rhonda A. Wilmoth, both of Rte. 2, Box 27A, Whitleyville, Tenn. 38588

[21] Appl. No.: 246,277

[22] Filed: Sep. 19, 1988

[51] Int. Cl.[4] ..... A47B 43/04

[52] U.S. Cl. ..... 248/346.1; 215/100.5; D7/45

[58] Field of Search ..... 248/346.1; 215/100.5; D7/45

[56] References Cited

U.S. PATENT DOCUMENTS

| | | | |
|---|---|---|---|
| 2,652,703 | 9/1953 | Keegan | 248/346.1 |
| 2,688,858 | 9/1954 | Cosmetto | 248/346.1 |
| 3,363,869 | 1/1968 | Blundell | 248/346.1 |
| 3,393,892 | 7/1968 | Buck | 248/346.1 |

FOREIGN PATENT DOCUMENTS

| | | | |
|---|---|---|---|
| 24721 | 12/1906 | Austria | 248/346.1 |
| 322884 | 10/1902 | France | 248/346.1 |
| 184845 | 9/1936 | Switzerland | 248/346.1 |
| 10896 | of 1903 | United Kingdom | 248/346.1 |

*Primary Examiner*—Alvin C. Chin-Shue
*Attorney, Agent, or Firm*—Pitts and Brittian

[57] ABSTRACT

A coaster for supporting drinking vessels containing, in particular, cold drinks that will absorb the condensation. The coaster will not stick to the drink vessel when the same is lifted for use. This is accomplished by having a coaster containing an absorbent layer in the base of a central recess and support rods spaced above that absorbent material and yet beneath the rim of the recess, whereby the drinking vessel is safely supported. The support bars have a configuration such that they present a minimum surface for contact with the drinking vessel and, thus, eliminate any sticking that could occur between the drinking vessel and the coaster.

13 Claims, 2 Drawing Sheets

NON-STICK DRINK COASTER

DESCRIPTION

TECHNICAL FIELD

This invention relates generally to coasters used for the protection of furniture from heat and moisture due to drinking vessels, and more particularly to a coaster to better accommodate drinking vessels containing very cold liquids such that the condensation forming on the surface thereof does not cause sticking of the vessel to the coaster.

BACKGROUND ART

It is well known that drinking vessels, such as cups, glasses and bottles, can cause damage to the surface of fine furniture due either to the heat of the drink in the vessel or due to the condensation that often occurs on the exterior surface of vessels containing very cold liquids. Many varieties of protective devices, referred to as "coasters", have been developed to give protection to furniture. One such device is that illustrated in U.S. Pat. No. 2,688,858, issued to A. J. Cosmetto on Sept. 14, 1954. This is a plastic coaster having a generally circular base and a central cup-like portion to receive the drinking vessel. It contains a replaceable absorbent disk in the bottom of the cup-like portion. This disk is held in place by a decorative grid-like element such that the drinking vessel is spaced above the absorbent layer. This decorative grid is in contact with the absorbent layer due to the construction of this particular device.

Another coaster that has been developed for this particular use is that described in U.S. Pat. No. 3,393,892, issued to S. Buck on July 23, 1968. This device also has a cup-shaped base and is provided with transverse rods at the upper edge thereof. In addition, an upstanding support structure is provided to prevent inadvertent tipping of the drinking glass or other object held by the coaster. No provision is made in this particular device for the absorption of any moisture that might collect due to condensation dripping from the drinking vessel.

Still another coaster developed for this general application is that described in U.S. Pat. No. 3,797,796, issued to H. D. Lansdowne on Mar. 19, 1974. This particular device has a dished tray of a non-porous material into which is inserted a pad having a nap of highly porous material on one side that will readily absorb the condensation, and the second side is a pliable substantially non-porous material to engage the interior of the base of the dish body to prevent slippage. The insert can be removed for washing if desired.

There are other coaster devices known in which there is a base having a dished-like recess with simply a disk of porous material, such as cork, secured in the bottom of the recess. While this type of coaster does accommodate the absorption of condensate dripping from the drinking vessel, surface tension of the moisture under the drinking vessel often causes the coaster to be lifted with the drinking vessel. When this occurs the coaster can suddenly release and drop to surface, thereby causing various damaging effects.

Accordingly, it is one object of the present invention to provide a coaster for use with drinking vessels, particularly of the type where condensation may occur on the exterior surface, that will readily absorb moisture dripping from the surface of the drinking vessel.

It is another object of the present invention to provide a coaster that permits the removal of moisture from the exterior a drinking glass, or the like, but characterized by the non-sticking of the coaster to the drinking vessel.

It is still another object of the present invention to provide a non-sticking type coaster for use with drinking vessels which permits the absorption of excess moisture and yet readily permits the re-evaporation of this moisture when the coaster is no longer in use.

It is a further object of the present invention to provide a decorative coaster for use with drinking vessels containing either hot or cold liquids that will prevent damage to furniture supporting the same, and which will not stick to the vessel when the vessel is lifted from the coaster surface.

These and other objects of the present invention will become more apparent upon a reading of the complete description thereof in combination with the following drawings.

DISCLOSURE OF THE INVENTION

In accordance with the present invention, there is provided a non-stick coaster for use with drinking vessels normally exhibiting a high degree of condensation on the surface when they contain cold liquids which has a base provided with a central depression or recess. This recess defines a rim at the top surface of the base, with this rim providing for retention of the drinking vessel. Spanning the recess below the rim, and yet spaced above the bottom thereof, are a plurality of substantially equally spaced bars. These bars are such as to present a minimum top surface of contact with the drinking vessel. The base of the recess contains a layer of absorbent material that is spaced below the lower edge of the spanning rods. Due to the minimum contact between the rods and the drinking vessel, the coaster will not be lifted when the drinking vessel is lifted even though there is considerable condensation on the surface of the drinking vessel. Furthermore, the spacing between the absorbent layer and the support rods permits the ready drying of the absorbent material when the coaster is not in use. In the preferred form, the support rods penetrate through the base such that their ends are exhibited at opposite sides of the base. The cross section of the rods can take on several configurations to provide the minimum contact surface.

BRIEF DESCRIPTION OF THE DRAWINGS

FIGS. 8, 9 and 10 are enlarged cross-sectional drawings of several configurations of support rods that can be used with the invention of FIGS. 1, 6, 7 and the like.

BEST MODE FOR CARRYING OUT THE INVENTION

Figure 1:
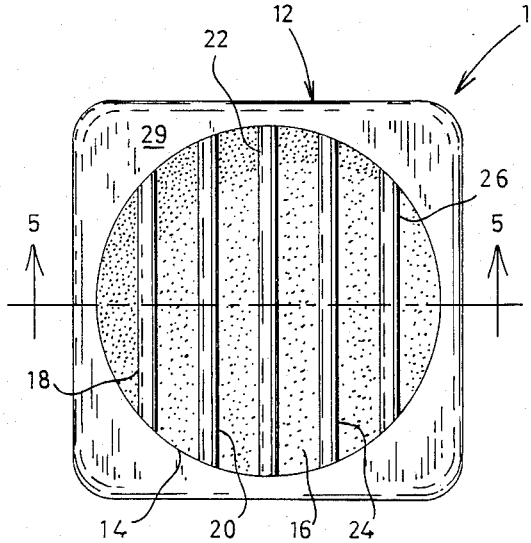
FIG. 1 is a top view of one embodiment of the present invention as developed to accomplish the above-stated objects.
Figure 5:
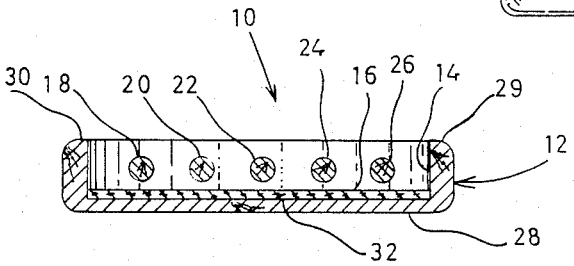
FIG. 5 is a cross-sectional view of the embodiment of the invention of FIG. 1 taken at 5—5 therein.

A preferred embodiment of the present invention is illustrated from the top in FIG. 1 at 10 therein. This embodiment has a generally square body member 12 with all corners gently rounded as shown. There is a central cylindrical recess 14 which does not go all the way through the body 12 as shown in FIG. 5. This recess 14 generally has straight sidewalls. The base of the recess 14 is covered with a thin absorbent layer 16 such as a thin layer of pressed cork. This layer typically is of the order of 1/64 inch in thickness. Spanning the recess in this embodiment are five substantially round dowels 18, 20, 22, 24 and 26 that, as seen in FIGS. 3 and 5, are positioned beneath the top surface 29 of the body 12.

Figure 2:
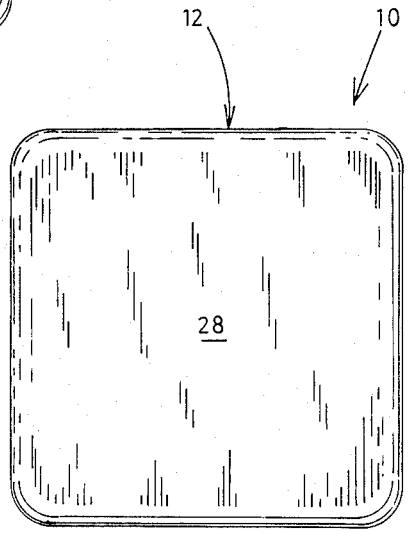
FIG. 2 is a bottom view of this embodiment of the present invention.
Figure 3:
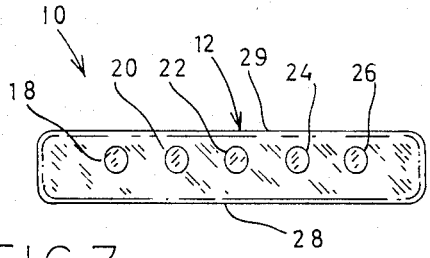
FIG. 3 is a front elevational view of the embodiment of FIG. 1.
Figure 4:
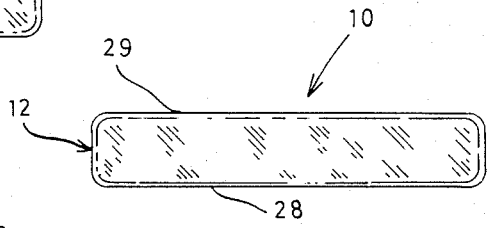
FIG. 4 is a side elevational view of the embodiment of the invention of FIG. 1.

FIGS. 2, 3 and 4 show other external views of the embodiment of the coaster of FIG. 1. FIG. 2, for example, is the bottom view illustrating that the bottom surface 28 is substantially planar so as to provide good support for the coaster upon any flat surface. FIG. 3 is a front elevational view of the embodiment of FIG. 1 showing that, in the preferred embodiment, the rods 18–26 actually project to the outer surface of the body 12 for ease of construction and for decorative purposes. And in FIG. 4, the other side elevation of the coaster is shown which again illustrates the rounded edges of the base 12.

Certain of the features of the present invention that are not immediately evident from FIG. 1 are more easily seen by referring now to FIG. 5. This is a cross-sectional view of the embodiment of FIG. 1 taken at 5—5 therein. It can be seen in this figure that the cylindrical recess 14 defines a lip 30 at the junction of the recess with the top surface 29. Also, the bottom of the recess 14 has a substantially planar surface 32 which supports the aforementioned disk of absorbent material 16. Of particular importance, it can be seen in this figure that the support rods 18≧26 are spaced above the layer of absorbent material. Not only does this permit ready insertion of the absorbent disk during fabrication, but its most important aspect is that any moisture collected by the absorbent material can be uniformly re-evaporated when the coaster is not in use, such that uniform drying of the absorbent layer is expedited. Without this feature, the absorbent material frequently will discolor due to uneven drying, due to mildew and other detrimental action. This spacing also permits the ready cleaning of the absorbent layer in the event that drink materials are spilled thereon. With the support rods 18–26 positioned beneath the rim 30, the rim 30 provides a stop for transverse movement of a drinking vessel supported by the coaster, which otherwise would occur if the rods are positioned flush with the top of the rim.

Figure 6:
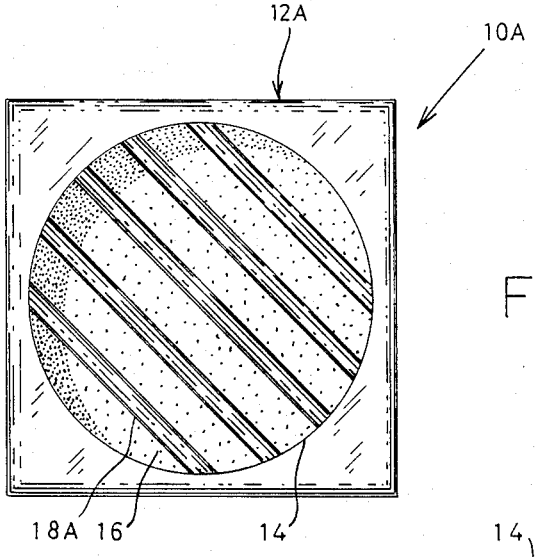
FIG. 6 is a top view of another embodiment of the present invention showing a different orientation of the support rods.

Still another embodiment of the present invention is illustrated at 10A in FIG. 6. In this embodiment, the body 12A retains a more regular square configuration, but has the central cylindrical recess 14 as in FIG. 1. The support rods 18A, etc., in this embodiment are oriented diagonally with respect to the edges of the body 12A, but provide the same function as those illustrated in FIG. 1. It should be pointed out that, although five support rods are shown in this and the other embodiments, this is just exemplary and other numbers of support rods can be used as long as uniform support is given to a drinking vessel supported thereon. As in the other embodiments, an absorbent layer 16 is employed to absorb moisture that is collected and drips from a drinking vessel into the recess 14. The rods 16A, etc., are positioned above this absorbent layer, but below the rim of the recess.

Figure 7:
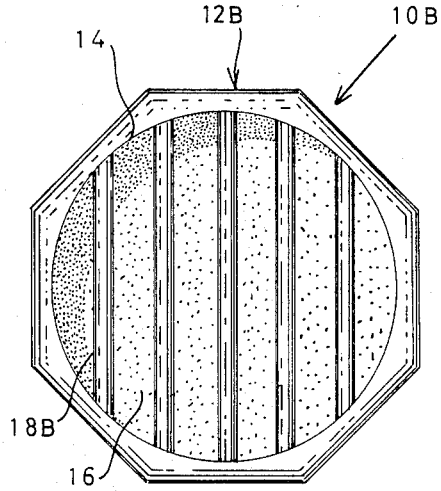
FIG. 7 is still another embodiment of the present invention.

Still another embodiment of the present invention is illustrated in FIG. 7 at 10B. In this embodiment, the body 12B has a generally octagonal outer configuration for increased decorative value. Except for this feature, the embodiment of FIG. 7 is substantially the same as that of FIG. 1 having a plurality of support bars spaced beneath the rim of the recess 14 and yet spaced above an absorbent layer 16 in the base of the recess. It will thus be recognized that the body portion of the present invention can take on numerous configurations.

Figure 8:
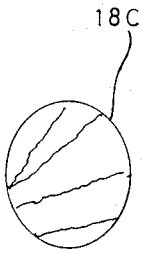
Figure 9:
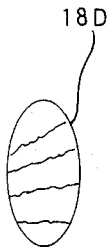
Figure 10:
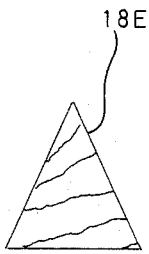

FIGS. 8, 9 and 10 depict enlarged cross sections of various configurations of support rods that are useful in the present invention. Each is such that a minimum contact is made between the support bar and a vessel supported thereby. In the embodiments of FIGS. 1, 6 and 7, the bars are illustrated as having a circular cross section. If desired, the cross section can be an oval as the bar 18C in FIG. 8, an ellipse as the bar 18D in FIG. 9 or a triangle as the bar 18E in FIG. 10. Other variations will become apparent to those versed in the art that will minimize the contact area between the support bar and the vessel. This minimal contact is essential to prevent sticking of the drinking vessel to the coaster when copious quantities of condensation are present. The particular configuration needs to be also aesthetically pleasing to blend with the decorative appearance of the overall coaster.

From the foregoing it will be understood that a coaster has been developed that is especially useful for drinking vessels containing cold liquids such that moisture condenses on the surface of these vessels. By having support bars of minimum contact area, the coaster and the drinking vessel do not stick to each other such that the vessel can be easily removed from the coaster. In addition, the support bars are positioned sufficiently above an absorbent layer within the coaster such that the condensation is easily absorbed during use and readily desorbed following use. In addition, the coaster has decorative value for use in any environment.

Although only limited embodiments of the present invention are shown and described herein, the specific embodiments are not intended to limit in any way the scope of the present invention. Rather, the invention is to be limited only by the appended claims and their equivalents when read in view of this description.

I claim:

1. A coaster for supporting a drinking glass or the like that is subject to forming condensed moisture on the exterior thereof, which comprises:

a base member having substantially planar top and bottom surfaces defined by edge surfaces, said base member provided with a recess in said top surface, said recess defining side walls of said base, and a rim at a junction of said recess with said top surface, said recess having a substantially flat bottom wall;

a layer of absorbent material positioned within said recess and supported upon said bottom wall of said recess; and a plurality of substantially parallel support rods spanning said recess, said rods each defining a top surface and a bottom surface, said top surface positioned below said rim, said bottom surface spaced above and separated from said absorbent material, said support rods having cross-sectional configuration whereby said top surface presents a minimum contact surface area to said drinking glass when said glass is supported thereon said support rods penetrating said side walls of said base to said edge surfaces.

2. The coaster of claim 1 wherein said support rods are circular in cross section.

3. The coaster of claim 1 wherein said support rods are spaced substantially equally between said rim and said absorbent material.

4. The coaster of claim 1 wherein said base member is a substantially rectangular prism as defined by straight edges and flat surfaces, with corners thereof rounded, and said support rods penetrate said base member to outer surfaces of one pair of opposite edges of said base member.

5. The coaster of claim 1 wherein between three and six support members span said recess for support of said glass.

6. The coaster of claim 5 wherein five support members span said recess.

7. The coaster of claim 4 wherein said top and bottom surfaces of said base member are substantially square and said recess is centered in said top surface.

8. A coaster for supporting a drinking glass or the like that is subject to forming condensed moisture on the exterior thereof, which comprises:

a base member having substantially square top and bottom surfaces, said base member defined by substantially straight edge surfaces joining said top and bottom surfaces, with corners thereof being rounded, said base member provided with a central recess in said top surface, said recess defining side wall, of said base, and a rim at said top surface and having a flat bottom wall;

a thin disk of an absorbent material within said recess and supported upon said bottom wall; and a plurality of substantially parallel support rods spanning said recess to define a support surface for said glass below said rim, said support rods having a bottom surface spaced above and separated from said absorbent material, said support rods having a cross-sectional configuration to present a minimum contact surface area to said glass to prevent sticking of said coaster to said glass, said support rods penetrating said side walls of said base member to extend to said edge surfaces thereof.

9. The coaster of claim 8 wherein said support rods have a circular cross section.

10. The coaster of claim 8 wherein said support rods have a triangular cross section, with an apex of said triangular cross section directed to support said glass.

11. The coaster of claim 8 wherein said support rods have an elliptical cross section

12. The coaster of claim 8 wherein said absorbent material is a disk of cork material

13. A coaster for the non-sticking support of a drinking glass or the like that is subject to producing condensation on the exterior surface thereof, which comprises:

a base member having substantially parallel top and bottom surfaces defined by edge surfaces, said top surface provided with a central recess, said recess defining side walls in said base member and a rim at said top surface, said recess having a bottom wall;

a thin layer of cork material positioned within said recess and fastened to said bottom wall, said cork material for absorbing said condensed moisture; and a plurality of substantially parallel support rods spanning said recess below said rim, and above and separated from said cork materials, for supporting said glass, said support rods having a substantially circular cross section to present a minimum contact top surface below said rim for contact with said glass and thereby preventing sticking to said glass, said support rods penetrating said side walls of said base to said edge surfaces.

* * * * *